US008294641B2

(12) United States Patent
Johnson et al.

(10) Patent No.: US 8,294,641 B2
(45) Date of Patent: Oct. 23, 2012

(54) OLED DISPLAY DEVICE

(75) Inventors: Mark T. Johnson, Veldhoven (NL); Nebojsa Fisekovic, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1240 days.

(21) Appl. No.: 10/564,917

(22) PCT Filed: Jul. 7, 2004

(86) PCT No.: PCT/IB2004/002291

§ 371 (c)(1),
(2), (4) Date: Jan. 17, 2006

(87) PCT Pub. No.: WO2005/008622

PCT Pub. Date: Jan. 27, 2005

(65) Prior Publication Data

US 2006/0279480 A1 Dec. 14, 2006

(30) Foreign Application Priority Data

Jul. 18, 2003 (GB) ..... 0316862.2

(51) Int. Cl.
*G09G 3/28* (2006.01)

(52) U.S. Cl. ..... 345/77; 345/76; 345/204; 345/589

(58) Field of Classification Search ..... 345/204, 345/76, 82, 92, 55

See application file for complete search history.

(56) References Cited

U.S. PATENT DOCUMENTS

| | | | | |
|---|---|---|---|---|
| 5,912,651 | A | 6/1999 | Bitzakidis et al. | |
| 6,326,941 | B1 * | 12/2001 | Yamazaki et al. | 345/95 |
| 6,429,601 | B1 * | 8/2002 | Friend et al. | 315/169.3 |
| 2002/0003520 | A1 * | 1/2002 | Aoki | 345/87 |
| 2003/0107536 | A1 | 6/2003 | Ishizuka et al. | |
| 2004/0155847 | A1 * | 8/2004 | Taoka et al. | 345/87 |
| 2006/0284894 | A1 * | 12/2006 | Johnson et al. | 345/690 |
| 2007/0126757 | A1 * | 6/2007 | Itoh et al. | 345/690 |

FOREIGN PATENT DOCUMENTS

| | | | |
|---|---|---|---|
| EP | 1282104 | A1 | 2/2003 |
| EP | 1333422 | A1 | 8/2003 |
| WO | 0227700 | A2 | 4/2002 |
| WO | 0239420 | A1 | 5/2002 |

* cited by examiner

*Primary Examiner* — Grant Sitta

(57) ABSTRACT

The invention relates to an active matrix display device comprising a display with a plurality of display pixels, each having a current driven emissive element, a data input for receiving an analogue data signal, at least one drive element connected to a power supply and arranged to drive the current emissive element in accordance with the data signal and selecting means arranged to provide, in response to a select signal, the data signal to the at least one drive element to generate an overall brightness level during a frame period in accordance with the data signal. The device is adapted to divide the frame period in at least a first sub-period during which the emissive element carries a first non-zero current and a second sub-period during which the emissive element carries a second non-zero current, the at least first and second non-zero current yielding the overall brightness level.

14 Claims, 6 Drawing Sheets

OLED DISPLAY DEVICE

The invention relates to an display device comprising a display with a plurality of display pixels. More specifically the invention relates to an active matrix display device, preferably comprising polymer light emitting diodes (PLEDs) or small molecule light emitting diodes (SMOLEDs).

Display devices of the hold type are known to suffer from what is known as sample/hold effects. These effects arise from the fact that in every frame period a new image may be displayed at the start of the frame period (sample), whilst in the remainder of the frame period (typically 16 ms for 60 Hz operation) the image remains visible on the display (hold). This effect is experienced by a viewer as a blurred image if moving images are displayed.

The image blurring effect can be reduced by operating the display in a pulsed mode, wherein the frame period is time-divided in two sub-frames, wherein only one the sub-frames is displayed. This pulsed mode operation, however, is disadvantageous in that high brightness levels are difficult to achieve.

US2002/0003520 discloses a display device being a hold type display device which holds a brightness of the antecedent picture until the subsequent signal is inputted to a pixel, wherein a frame displaying one picture is time divided into multiple sub-frames and the brightness of the subsequent sub-frame is attenuated at a designated ratio according to the brightness of the inputted picture. The thus obtained display device prevents a moving picture from being unclear and blurred and controls the lowering of the brightness in of the picture.

The prior art display device is disadvantageous in terms of power dissipation as the originally generated light signal from the liquid crystal display (LCD) backlight is attenuated afterwards. Power dissipation considerations are particularly relevant for mobile applications, such a cellular phones, laptops and personal digital assistants (PDA's).

It is an object of the invention to provide a display device that yields a higher energy efficiency whilst maintaining or improving the performance of the display device in terms of the sample/hold effect and light intensity.

This object is achieved by an active matrix display device comprising a display with a plurality of display pixels, each having:

- a current driven emissive element;
- a data input for receiving an analogue data signal;
- at least one drive element connected to a power supply and arranged to drive said current emissive element in accordance with said data signal;
- selecting means arranged to provide, in response to a select signal, said data signal to said at least one drive element to generate an overall brightness level during a frame period in accordance with said data signal, wherein said device is adapted to divide said frame period in at least a first sub-period during which said emissive element carries a first non-zero current and a second sub-period during which said emissive element carries a second non-zero current, said at least first and second non-zero current substantially yielding said overall brightness level. The emissive elements in such a device are current driven such that the light output for a particular element can be tuned to the required brightness output for a particular sub-period, thereby avoiding attenuation, and thus energy waste, of a previously generated signal. The active matrix display device may, in contrast to a liquid crystal display, switch between said sub-periods instantaneously.

In an embodiment of the invention the active matrix display device comprises a display controller for generating said select signal, said select signal comprising at least a first select signal triggering said first sub-period and a second select signal triggering said second sub-period. In this embodiment the display pixel is addressed more than once for each frame period by supplying various addressing pulses to the selecting means. In this way the distribution of current between the sub-periods can be chosen freely as long as the total of the currents carried by the emissive elements for the various sub-periods yields the overall brightness. In a preferred embodiment, the first current exceeds the second current and/or the first sub-period and said second sub-period are of different duration, such as a first sub-period of shorter duration than said second sub-period. Sample/hold effects are reduced further if the emissive element carries the first current for less than 50% of the frame period.

In an embodiment of the invention the active matrix display device comprises a display controller adapted to generate at least said first current and said second current by varying a voltage for said drive element. Preferably the voltage is varied via a power supply line or voltage supply line. In contrast to the previously discussed embodiment, this embodiment does not require substantial processing of the data signal. The display pixels can be dimmed in the second sub-period whilst only addressing these pixels once. Preferably the drive element is a thin film transistor (TFT) having a short channel length. Such a TFT exhibits a larger variation of the source-drain current with the source-drain voltage and has smaller dimensions enabling an increased pixel aperture.

In an embodiment of the invention the display pixels are arranged in a matrix of rows and columns, said device comprising lines for manipulating a voltage for said drive element for each row or group of rows, the latter option requiring less power lines, and said device comprises a display controller adapted to scan said lines along said rows or group of rows across the display in the direction of addressing. In this way the current emissive elements carry the second non-zero current, i.e. the dimmed state, for the same period of time. When groups of rows are scanned signal processing may be applied in order to increase the second non-zero current in the second sub-period slightly for the last rows of a group as to reduce any artefacts.

In an embodiment of the invention the active matrix display device is adapted to yield a brightness at said second non-zero current of 30% or less of the brightness at said first non-zero current. Perception studies have revealed that viewers experience an acceptable reduction of motion blur artefacts even if the second non-zero current yields a brightness of 30% of the brightness obtained by driving the first non-zero current through the current driven emissive element.

In an embodiment of the invention the active matrix display device contains a display comprising a subset of display pixels or emissive elements and said device is adapted to supply said first non-zero current and said second non-zero current to only said subset. Preferably the display pixels are coloured display pixels comprising red, green and blue emissive elements and the subset is defined by colour. For example, such a subset consists of red and blue elements only, as green light emitting elements are generally more efficient and exhibit extremely long lifetimes. The green elements may be driven in the pulsed mode, i.e. the frame period is divided in a sub-period wherein the emissive element emits light and a sub-period in which the emissive element does not emit substantial light. In this way driving is simplified and the sample/hold effect is further reduced. In another example the subset consists of said green elements only, while the red and blue emissive elements are simply driven in a non-pulsed mode. In this way, driving is further simplified, the display lifetime is extended as the red and blue emissive elements do not experience high currents and an acceptable image perception is maintained reducing the sample/hold effects of the (dominant) green elements.

It should be appreciated that the embodiments, or aspects thereof, may be combined.

The invention further relates to an electric device comprising a display device as described in the previous paragraphs. Such an electric device may relate to handheld devices such as a mobile phone, a Personal Digital Assistant (PDA) or a portable computer as well as to devices such as a Personal Computer, a television set or a display on e.g. a dashboard of a car. It is noted that the issue of power consumption is particularly relevant for battery powered devices.

The invention will be further illustrated with reference to the attached drawings, which show preferred embodiments according to the invention. It will be understood that the device and method according to the invention are not in any way restricted to this specific and preferred embodiment.

Figure 1:
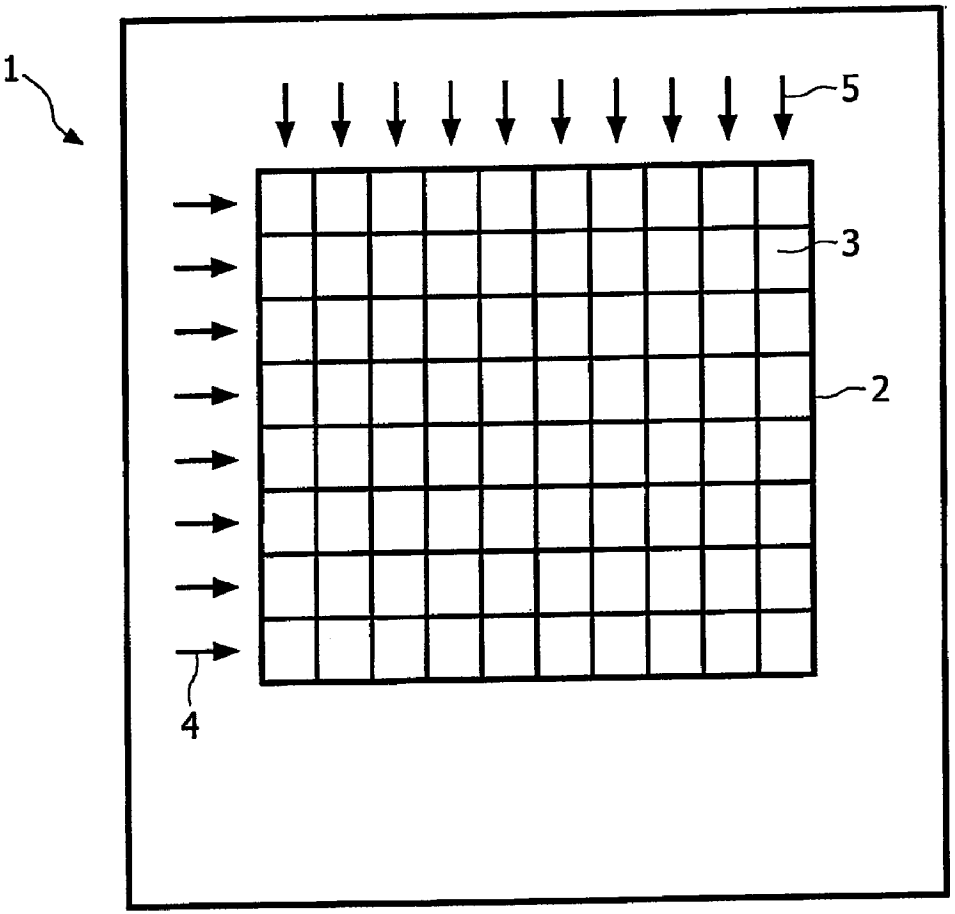
FIG. 1 shows an electric device comprising an active matrix display device according to an embodiment of the invention.

FIG. 1 shows an electric device 1 comprising an active matrix display 2 having a plurality of display pixels 3 arranged in a matrix of rows 4 and columns 5. The display 2 may be a large display. Motion artefacts generally are most visible on such large displays.

Figure 2:
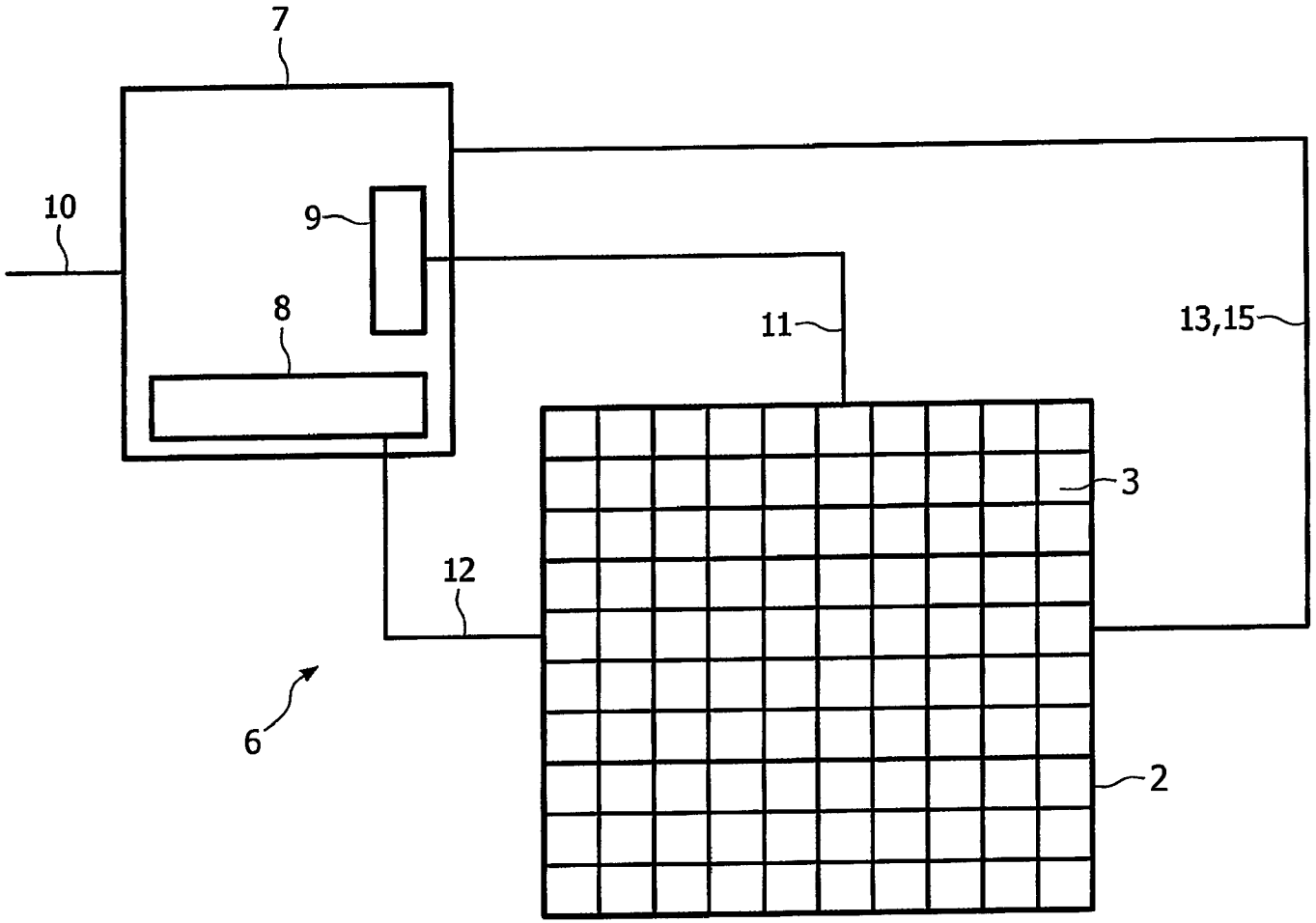
FIG. 2 shows a schematical illustration of the active matrix display device of the electric device shown in FIG. 1.

FIG. 2 shows a schematical illustration of an active matrix display device 6, comprising the display 2 of the electric device 1 as shown in FIG. 1. The display 2 comprises a display controller 7, including amongst others a row selection circuit 8 and a data register 9. A data signal, comprising information or data such as (video)images to be presented on the display, is received via data input 10 by the display controller 7. The data are written to the appropriate display pixels 3 from the data register 8 via data lines 11. The selection of the rows 4 of the display pixels 3 is performed by the row selection circuit 8 via selection lines 12, controlled by the display controller 7. Synchronization between selection of the display pixels 3 and writing of the data to the display pixels 3 is performed by the display controller 10. Moreover the display controller 7 controls the power supply of the display pixels 3 via power lines 13.

Figure 3:
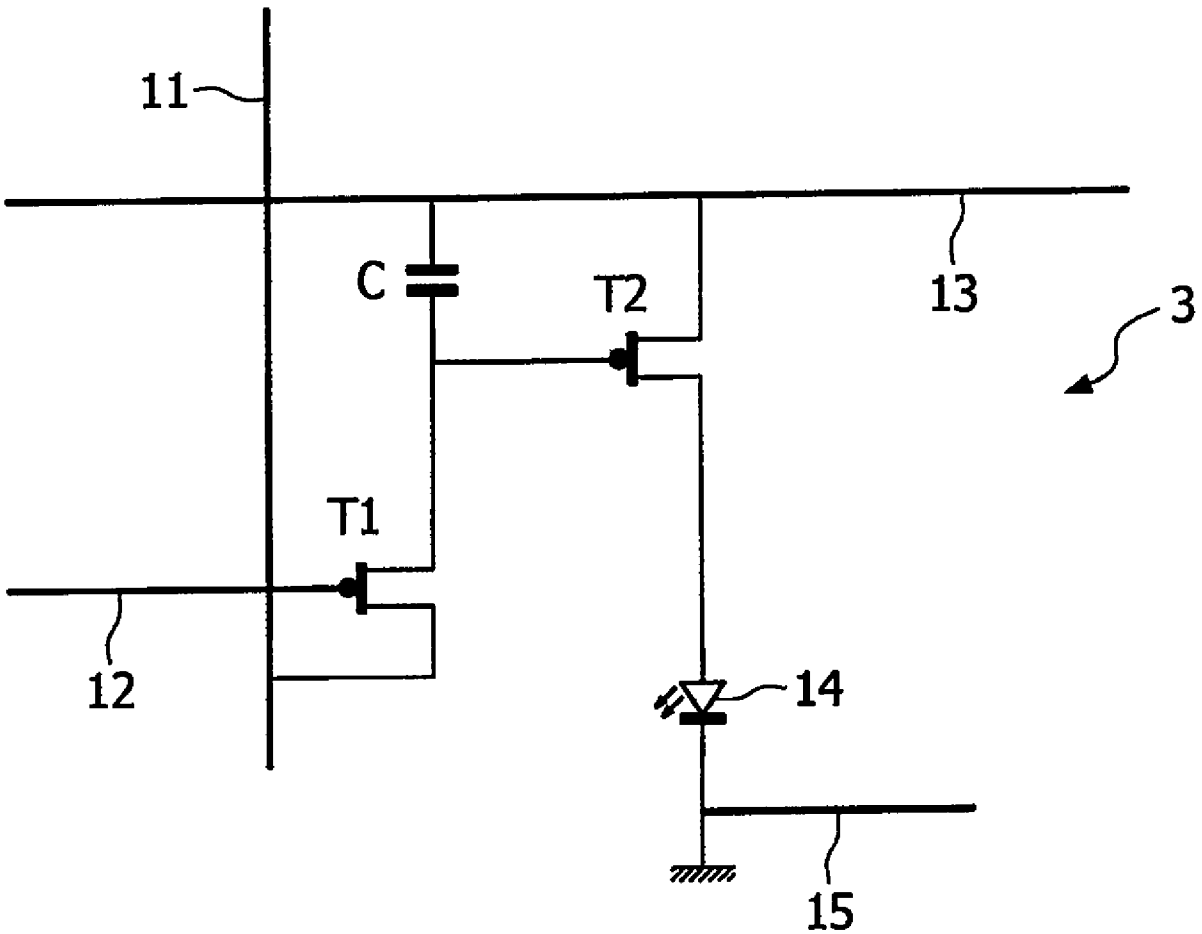
FIG. 3 shows a voltage addressed display pixel according to an embodiment of the invention.
Figure 3:
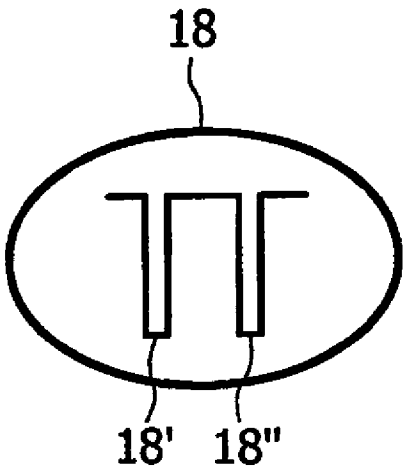
Figure 4:
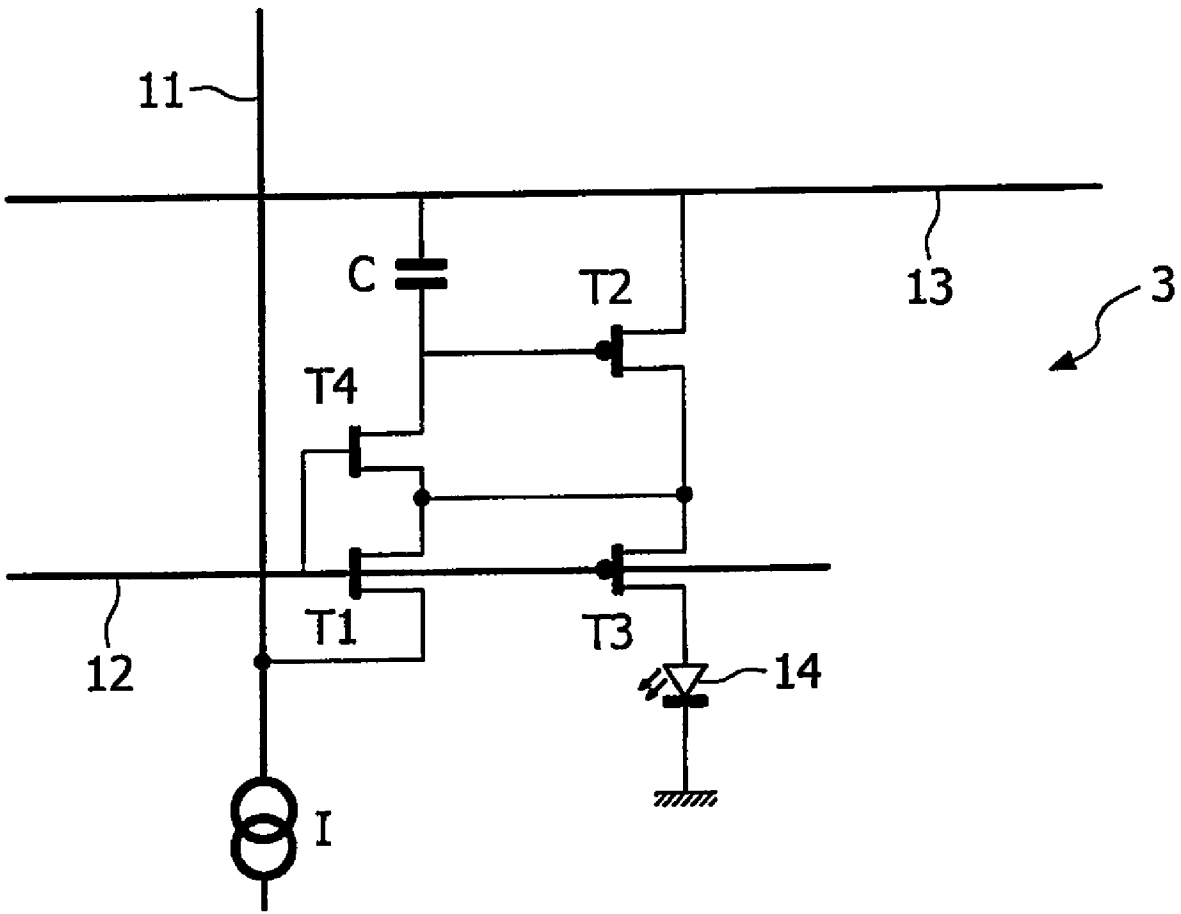
FIG. 4 shows a current addressed current mirror display pixel according to an embodiment of the invention.
Figure 4:
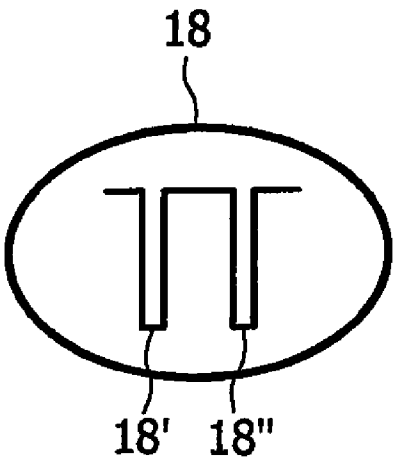

FIGS. 3 and 4 show two examples of circuit arrangements for the display pixels 3 for the active matrix display device 6.

FIG. 3 shows a voltage addressed circuit arrangement for a display pixel 3 comprising a selecting means, such as an addressing transistor T1, a storage capacitor C and a drive element T2 for applying a driving signal to a current driven emissive element 14. The transistor T1 is arranged to receive a select signal over the line 12 from the display controller 7. T1 passes the data signal for a particular frame to the gate of T2 if an appropriate select signal is received. T2 may be a p-Si thin film transistor (TFT) and the current driven emissive element 14 may be a light emitting diode, such as an polymer light emitting diode (PLED) or small molecule organic light emitting diode (SMOLED). One of the plates of the capacitor C and the source electrode of T2 are connected to the power supply line 13.

If T2 is biased in saturation it behaves as a constant current source, passing a current which is proportional to $\mu_{fe}\cdot(V_{GS}-V_T)^2$ where $V_{GS}$ is the gate-source voltage of T2, $V_T$ the threshold voltage, and $\mu_{fe}$ is the field effect mobility of T2. This constant current is then driven through the emissive element 14 which is connected to T2. Thus, the current source is programmed by setting the voltage on the gate of T2. This is conventionally achieved during a short addressing time of e.g. 25 μs by turning on T1 via line 12 and transferring the signal voltage from the data register 9 to the gate of T2. T1 is then switched off, and the programmed voltage is held on the gate of T2 for the rest of the frame time. The storage capacitor C prevents appreciable discharge of this node via leakage through T1, thus forming a memory to allow continuous LED current while the other rows 4 of the display 2 are selected sequentially. It is noted that voltage addressed display pixels 3 are known in many variants that may employ further transistors. Such variants fall under the scope of the present invention.

Another category of display pixel circuits are the current addressed display pixel circuits 3 shown in FIG. 4. The driving transistor T2 is used in both addressing the display pixel 3 and in driving the emissive element 14. The data input signal is applied as a current rather than a voltage over the line 11, indicated by the current source I. During the addressing period the driving transistor T2 is diode-connected by the transistor T4 via addressing transistor T1, and the emissive element 14 is isolated from the circuit by the transistor T3. During this addressing period the data input current is forced through T2 while the capacitor C is charged to reach the associated gate-source voltage $V_{GS}$ for T2. Now, by opening T1 and T4 and by closing T3, the drain current is fed to the emissive element 14. The memory function of the capacitor C assures the current to be a perfect copy of the data input current received over line 11.

Figure 5:
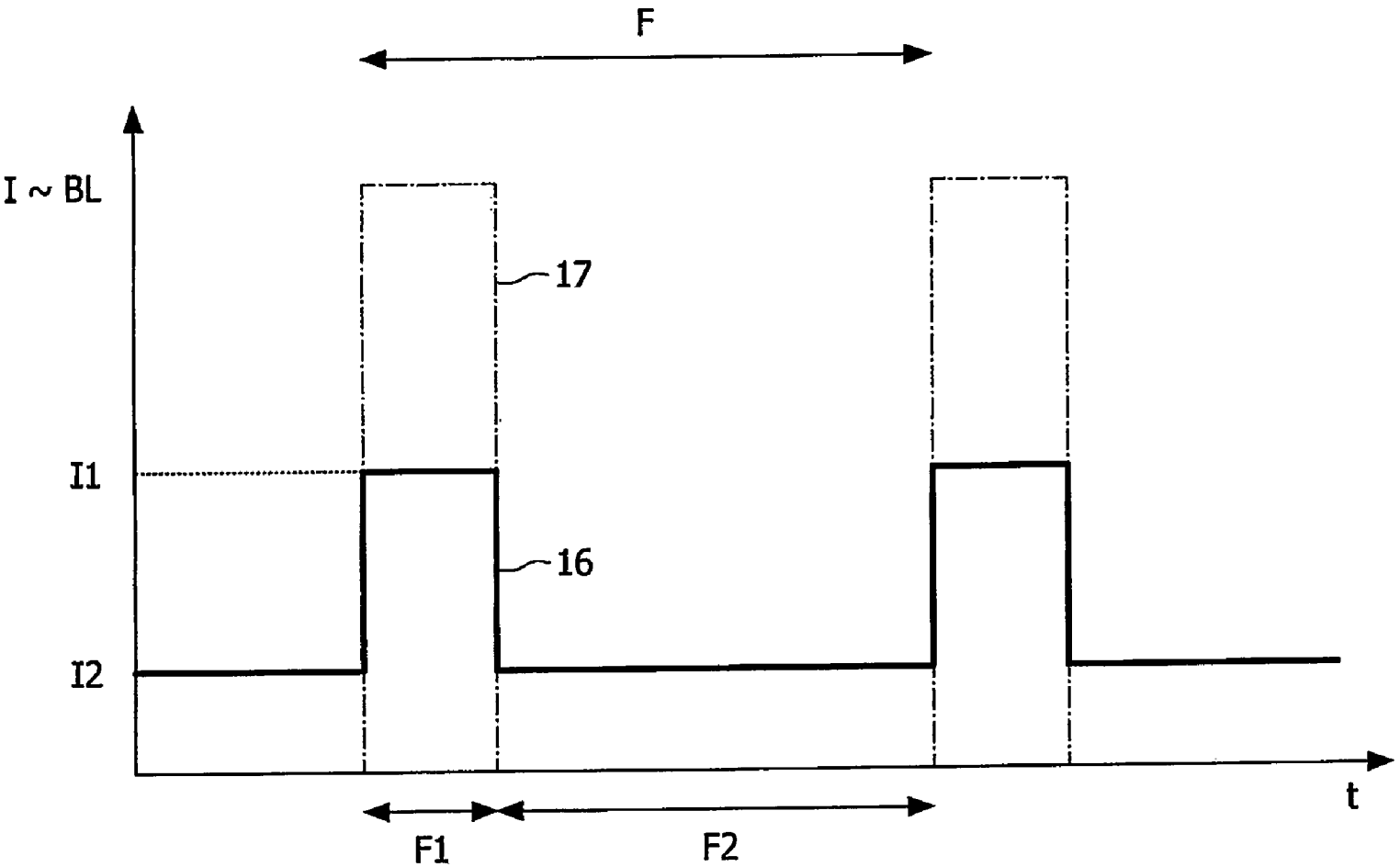
FIG. 5 shows a light emission profile according to an embodiment of the invention.

FIG. 5 shows an illustration of a light emission profile according to an embodiment of the invention. The light emission profile is obtained by the active matrix display device 6 that is adapted to divide the frame period F in at least a first sub-period F1 during which the emissive element 14 carries a first non-zero current I1 and a second sub-period F2 during which the emissive element 14 carries a second non-zero current I2. As the currents I1 and I2 are proportional to the light output or brightness levels BL for the sub-periods F1 and F2, the respective light outputs yield the overall brightness level of the display pixel 3 for the frame period F.

The invention enables the device 6 to achieve the same overall brightness level (=integral area under the curve 16) by maintaining a finite current I2 through the emissive element 14 without requiring the high peak brightness represented by the dashed line 17. This reduces power dissipation and may result in an extended lifetime of the display 2 as the peak currents are lower. The emissive elements 14 are current driven such that the light output for a particular element 14 can be exactly tuned to the required brightness level for the particular sub-periods F1 and F2. The active matrix display device 6 may, in contrast to a liquid crystal display, switch between current I1 and I2 instantaneously. Perception studies have revealed that motion blur artefacts are perceived as being reduced even if I2 is 30% or less than I1.

It is noted that the profile 16 in FIG. 5 only illustrates a simple example. More complex profiles may be generated from the display controller 7, including varying peak currents I1 in subsequent frame periods F, the current I2 being kept at an fixed or variable ratio or a stable level for the sub-period F2, and multiple sub-periods F1, F2, . . . Fn having corresponding non-zero currents I1, I2, . . . In. The sub-periods F1 and F2 may be of different duration.

Next several embodiments to obtain the profile 16 of FIG. 5 will be described.

In an embodiment the display controller 7 of the active matrix display device 7 generates a select signal 18, as displayed in FIGS. 3 and 4. The select signal 18 comprises a first select signal 18' triggering the first sub-period F1 and a second select signal 18" triggering the second sub-period F2 of FIG. 5. The display pixel 3 is thus voltage- or current addressed more than once for each frame period F by supplying various addressing pulses to the selecting means T1 and T1, T3, T4 respectively. The display controller 7 processes the data signal received over input 10 and distributes the data signal for the frame period F as a current I1 fed to the emissive element 14 for the sub-period F1 and a current I2 fed to the emissive element 14 for the sub-period F2. Multiple sub-periods F1 . . . Fn can be obtained by applying multiple address pulses to the selection means.

In another embodiment the display controller 7 is adapted to generate at least said first current I1 and said second current I2 by varying a voltage over said current driven emissive element 14. This can be performed by controlling the power supply over line 13, such that in sub-period F1 the current carried by emissive element 14 is I1, whereas the current carried during sub-period F2 is I2. Alternatively a voltage over the light emissive element 14 can be controlled by the display controller 7 via line 15. This embodiment is more time efficient as no signal processing of the data signal is required.

Figure 6:
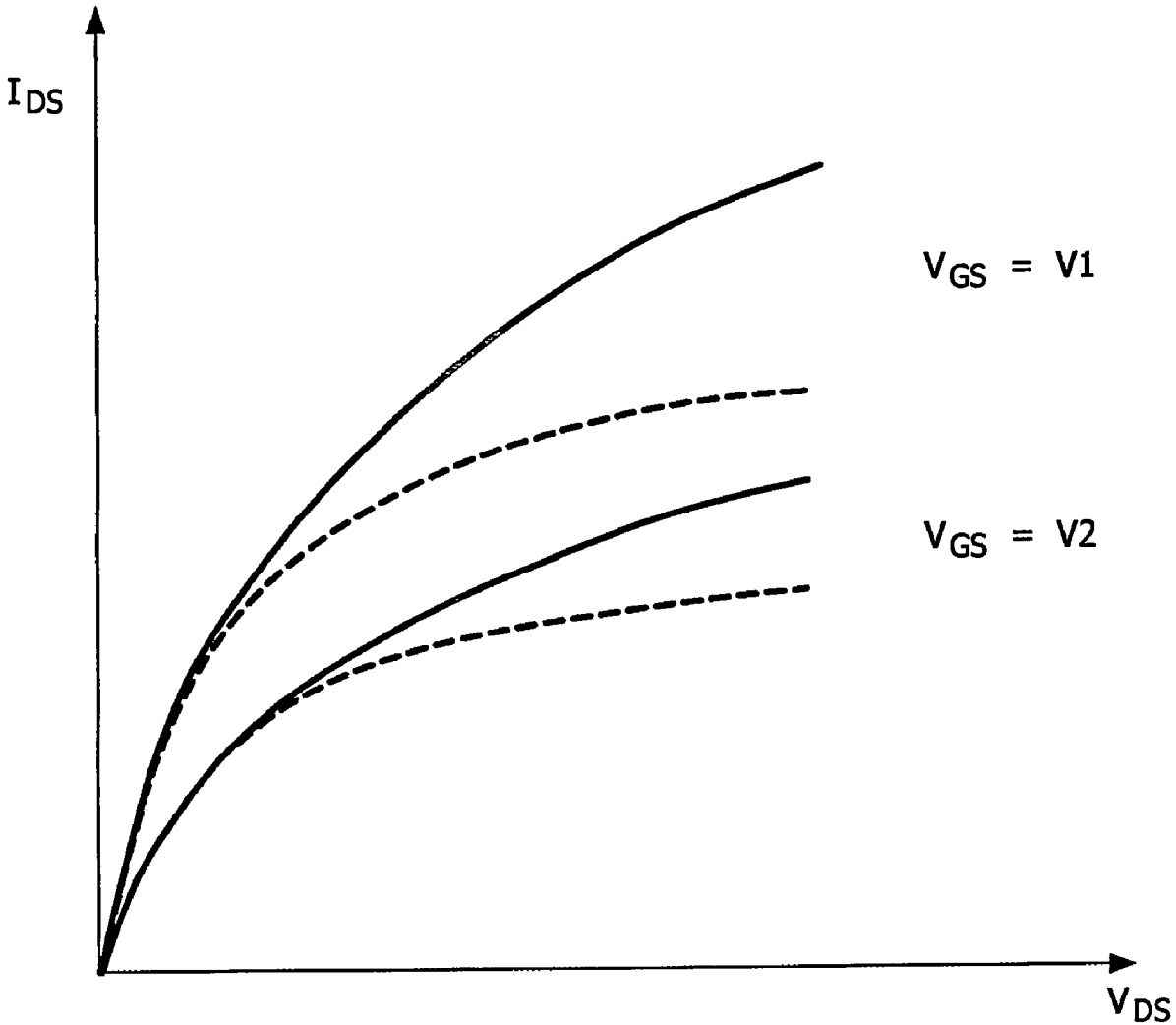
FIG. 6 shows an output characteristic of a typical PMOS thin film transistor as a function of the drain-source voltage for different data signals ($V_{gs}$).

FIG. 6 shows an output characteristic of a typical PMOS thin film drive transistor T2 as a function of the drain-source voltage $V_{DS}$ for different data signals ($V_{GS}$=V1; $V_{GS}$=V2, where V2>V1). Apparently for all brightness levels BL of the display pixels 3 (defined by the gate-source voltages) the current through the drive transistor T2 reduces as the drain-source voltage $V_{DS}$ decreases. Therefore, all display pixels 3 can be dimmed by manipulating the voltage over the emissive element 14, as required during sub-period F2, while only addressing the display pixel 3 once. The voltage from the power supply line 14 is again increased to obtain I1 just before the next addressing period. Such variations of the voltage can be obtained instantaneously allowing fast and accurate control over the current carried by the emissive element 14.

In FIG. 6, the solid curves represent characteristics of the drive transistor T2 having short channel lengths (e.g. 4 microns), while the dashed curves represents a long channel length driving transistor T2 (e.g. 50 microns). Clearly the variation of the current $I_{DS}$ of T2 is more pronounced for short channel lengths, as a consequence of which short channel lengths driving transistors may be preferred to achieve the reduction of the current I2 to 30% of I1. Moreover such small dimensions are advantageous for the aperture of the display pixel 3.

In order to achieve a uniform image on the display 2, it is preferred that the reduction of the voltage of the emissive element 14 can be scanned along the rows 4 (shown in FIG. 1) of the display 2 from top to bottom in the direction of addressing. In this way all display pixels 3 can be dimmed during a same period F2. Such an embodiment can be obtained by providing individual power lines 13 or voltage lines 15 for either each row of display pixels 3 or, more realistically, for a group of adjacent rows 4 to limit the number of power lines 13, 15. For such group of rows 4, the display controller 7 may process the signal to reduce any artefacts related to changing the voltage of the power lines 13 or voltage lines 15 of a group of rows 4 simultaneously. In some embodiments, this processing may involve a slight increase of the current I1 for the last rows 4 of each group as the display pixels 3 of these rows 4 carry this current for a slightly shorter time.

The previous embodiments involving the multiple addressing and the variation of the voltage over the emissive element 14 may be implemented to coloured display pixels 3 of an active matrix display 2 as well.

Typically a coloured display pixel 3 comprises a red, green and blue emissive element 14 whereas the display device 6 is adapted to drive these emissive elements independently of each other. It was observed that some of the emissive elements 14 are more efficient than others in term of light output and moreover that the lifetime of emissive elements may vary considerably from colour to colour. Particularly green emissive organic light emitting diodes yield a high light output, i.e. more light per electron and show extremely long lifetimes. Therefore in an embodiment of the invention the display 2 comprises a subset of display pixels 3 or emissive elements 14 and said device 6 is adapted to supply said first non-zero current and said second non-zero current to only said subset. This subset may be defined on the basis of colour of the light emissive elements 14. As an example only the red and blue light emissive elements 14 may be addressed multiple times in a frame period F to divide this period F in sub-periods F1 . . . Fn during which only said red and blue emissive elements 14 carry non-zero currents I1 . . . In, whereas the green light emissive elements 14 can be driven in a simple pulsed mode (see curve 17 in FIG. 5), i.e. a reduced duty cycle. It is noted that alternatively the voltages over the red and blue emissive elements may be varied instead of multiple addressing.

As another example only the green emissive elements 14 are manipulated, e.g. by varying the voltage over these elements during the frame period F, while the red and blue emissive elements 14 are simply driven continuously during this frame period F. In this way the driving of the display 2 is simplified even further and the lifetime of the display 2 is extended as the red and blue emissive elements 14 experience no high current pulses. Sample/hold effects are reduced by perception by solely manipulating the dominant green emissive elements 14.

Examples of sub-sets other than those defined by colour may, for instance, include video windows in multi-media displays, and frequently used pixels, such as those used in icons of standby mode etc.

The invention claimed is:

1. Active matrix display device (6) comprising a display (2) with a plurality of display pixels (3), each having:

a current driven emissive element (14);

a data input (10) for receiving an analogue data signal;

at least one drive element (T2) connected to a power supply and arranged to drive said current emissive element (14) in accordance with said data signal;

selecting means arranged to provide, in response to a select signal (18), said data signal to said at least one drive element (T2), said data signal provided during a frame period generating a brightness level, wherein said device (6) is adapted to divide said frame period (F) into a first sub-period (F1) during which said emissive element (14) carries a first non-zero current (I1) and a second sub-period (F2) during which said emissive element (14) carries a second non-zero current (12), wherein said second non-zero current is maintained at a stable level lower than the first nonzero current and said first nonzero current being reduced in value based on a known ratio with respect to said second non-zero current, said second non-zero current during said second sub-period achieving a brightness that is known percentage of a brightness achieved by said first non-zero current in said first sub-period, wherein said at least first and second non-zero current over their respective sub-periods together yields a brightness level substantially equal to said brightness level generated by said data signal provided during said frame period.

2. Active matrix display device (6) according to claim 1, wherein said device (6) comprises a display controller (7) for generating said select signal (18), said select signal (18) comprising a first select signal (18') triggering said first sub-period (F1) and a second select signal (18") triggering said second sub-period (F2).

3. Active matrix display device (6) according to claim 1, wherein said first sub-period (F1) and said second sub-period (F2) are of different durations.

4. Active matrix display device (6) according to claim 3, wherein said first sub-period (F1) has a shorter duration than said second sub-period (F2).

5. Active matrix display device (6) according to claim 1, wherein said first non-zero current exceeds said second non-zero current.

6. Active matrix display device (6) according to claim 1, wherein said device (6) comprises a display controller (7) adapted to generate said first current (Ii) and said second current (12) by varying a voltage (13;15) over said current driven emissive element (14).

7. Active matrix display device (6) according to claim 1, wherein said drive element (T2) is a thin film transistor having a short channel length.

8. Active matrix display device (6) according to claim 1, wherein said display pixels (3) are arranged in a matrix of rows (4) and columns (5), said device (6) comprising lines (13,15) for manipulating a voltage for said drive element (T2) for each row (4) or group of rows (4), and said device (6) comprises a display controller (7) adapted to scan said lines (13:15) along said rows (4) or group of rows (4) across the display (2).

9. Active matrix display device (6) according to claim 1, wherein said device (6) is adapted to yield a brightness at said second non-zero current (I2) of 30% or less of the brightness at said first non-zero current (I1).

10. Active matrix display device (6) according to claim 1, wherein said display (2) comprises a subset of display pixels (3) or emissive elements (14) and said device (6) is adapted to supply said first non-zero current (I1) and said second non-zero current (I2) to only said subset.

11. Active matrix display device (6) according to claim 10, wherein said display pixels (3) are colored display pixels comprising red, green and blue emissive elements (14) and said subset is defined by colored.

12. Active matrix display device (6) according to claim 11, wherein said subset consists of said red and blue emissive elements (14).

13. Active matrix display device (6) according to claim 11, wherein said subset consists of said green emissive elements.

14. Electronic device (1) comprising an active matrix display device (6) comprising plurality of display pixels (3), each having: a current driven emissive element (14);

a data input (10) for receiving an analogue data signal;

at least one drive element (T2) connected to a power supply and arranged to drive said current emissive element (14) in accordance with said data signal;

selecting means arranged to provide, in response to a select signal (18), said data signal to said at least one drive element (T2) to generate an overall brightness level during a frame period (F) in accordance with said data signal, wherein said device (6) is adapted to divide said frame period (F) into a first sub-period (F1) during which said emissive element (14) carries a first nonzero current (I1) and a second sub-period (F2) during which said emissive element (14) carries a second non-zero current (I2), wherein said second nonzero current is maintained at a stable level lower than the first non-zero current and said first non-zero current is reduced in value based on a known ratio with respect to said second non-zero current, said second non-zero current during said second sub-period achieving a brightness that is known percentage of a brightness achieved by said first non-zero current in said first sub-period, wherein said first and second non-zero current over their respective sub-periods together yielding a brightness level substantially equal to said overall brightness level generated by said data signal when applied during said frame in accordance with said data signal.

* * * * *